United States Patent [19]

Lesniak

[11] Patent Number: 4,604,015

[45] Date of Patent: Aug. 5, 1986

[54] MEANS FOR RETAINING A RADIATOR RIGID

[75] Inventor: Thomas A. Lesniak, South Bend, Ind.

[73] Assignee: McCord Heat Transfer Corporation, Walled Lake, Mich.

[21] Appl. No.: 587,424

[22] Filed: Mar. 8, 1984

[51] Int. Cl.[4] ..... F16B 43/02

[52] U.S. Cl. ..... 411/537; 411/400; 165/67; 248/234; 403/405.1

[58] Field of Search ..... 411/400, 531, 401, 537, 411/538; 248/63, 70, 234; 403/43, 44, 46, 405, 408; 165/67

[56] References Cited

U.S. PATENT DOCUMENTS

| | | | |
|---|---|---|---|
| 2,506,051 | 5/1950 | Young | 165/67 |
| 3,880,090 | 4/1975 | Duclos | 411/400 |
| 4,289,059 | 9/1981 | Alderton | 411/400 |
| 4,295,770 | 10/1981 | Alderton | 411/531 |

FOREIGN PATENT DOCUMENTS

| | | | |
|---|---|---|---|
| 3000259 | 7/1981 | Fed. Rep. of Germany | 165/67 |
| 2320449 | 3/1977 | France | 248/234 |

*Primary Examiner*—Thomas J. Holko
*Assistant Examiner*—Neill Wilson
*Attorney, Agent, or Firm*—Gary M. Gron; Robert T. Ruff

[57] ABSTRACT

There is disclosed a mechanism for retaining an automotive radiator rigid, including sleeve members mounted on oppositely disposed portions of the radiator and an interconnecting rod member. Arcuate-shaped edge portions are formed on oppositely disposed portions of the radiator, each of the sleeve members having longitudinal bores formed therethrough and including arcuate-shaped groove bottoms opening in a direction generally parallel to the longitudinal axis of the sleeve members matching the arcuate-shaped edge portions and being slidably mounted thereon so as to have the bores thereof aligned. A rod is mounted across the radiator and extended through the aligned bores and secured therein by nuts mounted on the threaded ends against the respective sleeves, to thereby rigidify the radiator for use on trucks and off-highway vehicles.

3 Claims, 5 Drawing Figures

MEANS FOR RETAINING A RADIATOR RIGID

TECHNICAL FIELD

This invention relates generally to means for retaining an engine cooling radiator in a rigid position on vehicles, particularly trucks and off-highway vehicles, and, more particularly, this invention relates to cooperating sleeve and rod mechanisms for such automotive radiators.

BACKGROUND ART

Heretofore, soft or resilient mounting systems have been employed to isolate radiators on vehicles, or where sleeves and rods have been used, they have generally been attached to radiators by welding one or both sleeves to diagonally opposite side channel gusset plates and threadedly securing a cross rod therebetween. As such, each sleeve must be welded to a gusset plate at a precise angle in order for the tie rod to be aligned properly with a similar sleeve welded to a gusset plate at the diagonally opposite corner. This requires the use of welding fixtures and prevents a gusset plate welded for a particular size radiator from being used with a different size radiator.

DISCLOSURE OF THE INVENTION

A general object of the invention is to provide an improved means for retaining a vehicular radiator in a rigid position on the vehicle.

Another object of the invention is to provide an improved sleeve and cross rod or tie rod arrangement for use on a vehicular radiator.

A further object of the invention is to provide a sleeve and cross rod or tie rod arrangement for a vehicular radiator, wherein identical sleeves are slidably and adjustably mounted on arcuate edge portions formed on oppositely disposed gusset plates or side channels, with cross rods or tie rods threadedly mounted therebetween.

Still another object of the invention is to provide a sleeve and cross rod or tie rod arrangement for a vehicular radiator, wherein a circular opening is formed in a typical gusset plate, and a sleeve having an arcuate shaped, laterally extending groove formed therein is mounted on an edge portion of the circular opening. As such, two sleeves mounted on the edges of diagonally oppositely disposed gusset plate openings are slidably and adjustably located thereon to accommodate a threaded rod being readily extended through axially aligned longitudinal openings formed through the sleeves and secured thereto to help retain the radiator in a rigid mode.

These and other objects and advantages of the invention will be apparent when reference is made to the following description and accompanying drawings.

BEST MODE OF CARRYING OUT THE INVENTION

Figure 1:
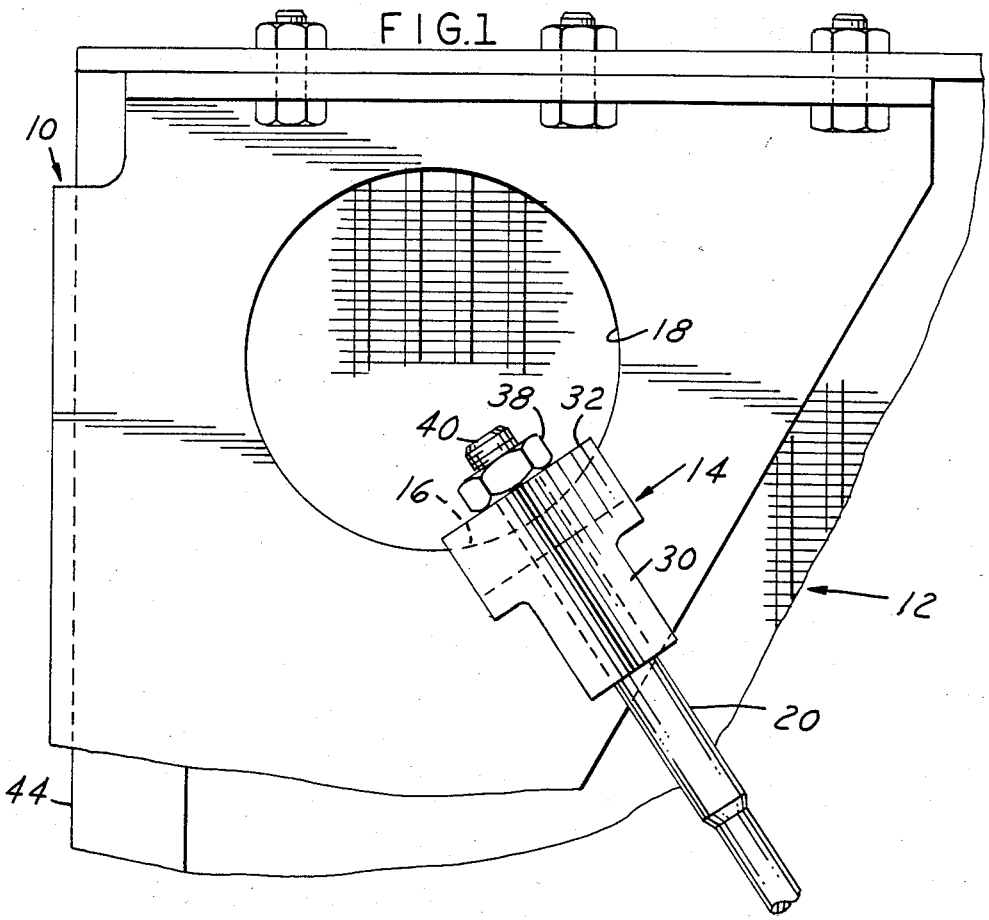
FIG. 1 is a fragmentary front elevational view of a heat exchanger arrangement embodying the invention.
Figure 2:
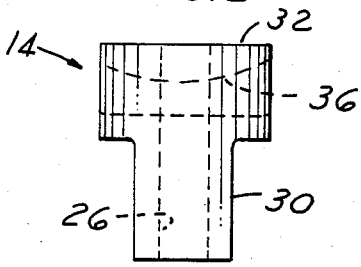
FIGS. 2–4 are front, side and bottom views of a component of the FIG. 1 structure.

Referring now to the drawings in greater detail, FIGS. 1 and 2 illustrate a corner gusset plate 10 of a radiator, represented at 12, having a cross rod sleeve 14 slidably mounted on the peripheral edge 16 of a circular opening 18 formed in the gusset plate. A second cross rod sleeve 14 is mounted on the edge of the diagonally opposite corner gusset plate (not shown). A cross rod 20 extends therebetween, as will be explained.

Figure 3:
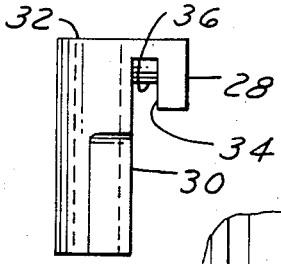
Figure 4:
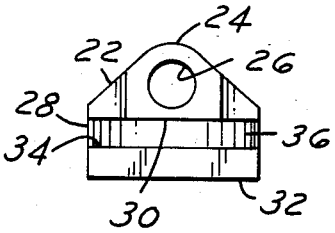

As shown in FIGS. 2–4, the cross rod sleeve 14 is machined or formed as a stamping to include a substantially triangular-shaped body portion 22 with one apex thereof rounded off to form an arcuate-shaped wall 24 (FIG. 4) around the adjacent portion of a bore 26 formed longitudinally through the sleeve.

A ledge or lip 28 is formed to extend from the widest side 30 (FIG. 4) of the triangular body portion 22, opposite the wall 24, adjacent one end 32 of the sleeve 14. A laterally extending groove 34 (FIG. 3) is formed in the lip 28 adjacent the side 30 so as to open in a direction away away from the end 32 in a direction generally parallel to the longitudinal axis of the sleeve. An arcuate-shaped bottom surface 36 (FIG. 2) is formed in the groove 34 on a radius which has its center beyond the end portion 30 and which coincides with the radius of the circular opening 18 formed in the gusset plate 10.

At the installation of the two cross rod sleeves 14, each is mounted with the groove bottom surface 36 thereof seated on portions of the diagonally opposite edges 16 of the openings 18, such that the bores 26 of the sleeves are aligned. The cross rod 20 is extended through the bores 26, and tightened therein as required by nuts 38 threadedly secured to the two extended threaded ends 40 of the cross rod and abutted against the respective sleeves 14. This serves to hold the radiator 12 in its original square or rectangular shape, while resisting distortion such as would tend to occur on a radiator mounted on a truck or an off-highway vehicle while being operated on uneven terrain.

Figure 5:
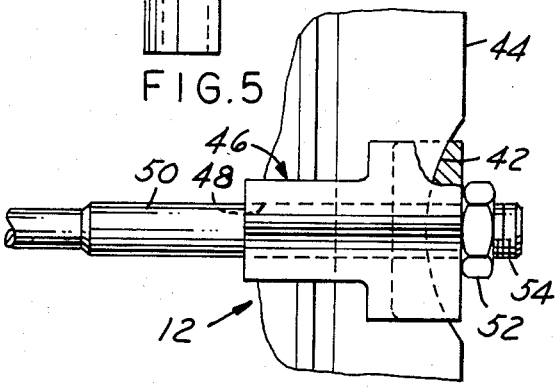
FIG. 5 is a fragmentary front elevational view of an alternate embodiment of the invention.

In some installations it may be appropriate to form one or more sets of horizontally aligned arcuate edge portions 42 on oppositely disposed radiator side channels 44, as shown in FIG. 5. In this event, a tie rod sleeve 46, which may be identical to the cross rod sleeve 14, is mounted on each arcuate edge portion 42, so as to have the respective bores 48 thereof aligned. A tie rod 50 is extended therethrough and secured in place by nuts 52 threadedly mounted on the respective threaded ends 54 against the respective sleeves 46.

INDUSTRIAL APPLICABILITY

It should be apparent that the invention provides an efficient, economical and readily adaptable sleeve and rod means for providing rigidity to a radiator mounted on a truck or off-highway vehicle.

While but two general embodiments of the invention have been shown and described, other modifications thereof are possible.

The embodiments of the invention in which an exclusive property or privilege is claimed are defined as follows:

1. For use on an engine cooling radiator including sets of oppositely disposed corner gusset plates and side channels, means for retaining said radiator rigid, said means comprising an arcuate edge portion formed on each of one of said sets of oppositely disposed corner gusset plates and side channels, a sleeve mounted on each of said arcuate edge portions, each of said sleeves including a body, a longitudinal bore formed through said body, a ledge formed adjacent one end of said body, an arcuate-shaped groove formed in said ledge, said arcuate-shaped groove having a radius matching the radius of said arcuate edge portion and being slidably mounted thereon, said arcuate-shaped groove opening in a direction generally parallel to the longitudinal axis of said sleeve whereby said sleeve may be hooked over said arcuate edge to hold said corner gusset plates in tension, a rod having threaded ends extended through aligned bores of said sleeves, and a nut threadedly secured on each threaded end against said adjacent sleeve.

2. The means for retaining said radiator rigid described in claim 1, wherein said arcuate edge portion is a portion of a circular opening formed in each corner gusset plate.

3. The means for retaining said radiator rigid described in claim 1, wherein said arcuate edge portion is formed on an edge of each of said side channels.

* * * * *